United States Patent [19]

O'Brien

[11] Patent Number: 4,558,475

[45] Date of Patent: Dec. 17, 1985

[54] CURTAIN FOR SHOWER DOORS

[76] Inventor: Kay I. O'Brien, 209 Red Hawk La., Marshfield, Wis. 54449

[21] Appl. No.: 515,137

[22] Filed: Jul. 19, 1983

[51] Int. Cl.[4] ..... A47K 3/22

[52] U.S. Cl. ..... 4/607; 4/608; 4/609; 160/327; 160/328

[58] Field of Search ..... 4/607, 608, 609, 610; 160/327, 328, 329

[56] References Cited

U.S. PATENT DOCUMENTS

| | | | |
|---|---|---|---|
| 1,267,197 | 5/1918 | Euler | 160/328 |
| 2,223,145 | 11/1940 | Wise | 160/329 |
| 2,236,986 | 4/1941 | Beeman et al. | 160/329 |
| 2,331,600 | 10/1943 | Dillow | 160/329 X |
| 2,728,390 | 12/1955 | Turner, Jr. | 160/327 |
| 2,751,001 | 6/1956 | Land | 160/328 |
| 2,880,797 | 4/1959 | Alvarez et al. | 160/328 |
| 2,934,782 | 5/1960 | Wootton | 160/329 X |
| 3,074,077 | 1/1963 | Taubman | 4/607 |
| 3,304,995 | 2/1967 | Goldstein | 160/327 |
| 4,335,774 | 6/1982 | Price | 160/329 X |

*Primary Examiner*—Henry K. Artis

*Attorney, Agent, or Firm*—Andrus, Sceales, Starke & Sawall

[57] ABSTRACT

Screening or curtaining arrangement for covering a shower door includes a curtain positioned across the door. The curtain has a rod pocket at each end containing a rod. A plurality of attachment members hook around the rod and the top and bottom of the shower door for retaining the curtain on the door. The attractiveness of the shower door is thereby enhanced.

9 Claims, 4 Drawing Figures

CURTAIN FOR SHOWER DOORS

In recent years the use of doors on shower stalls and for tub enclosures has become increasingly common. One to three doors are usually provided. Double or triple doors usually slide from an open position in which they are one behind the other to a closed position in which they are side by side. Or, the doors may be side hinged or pivotally mounted at the top and bottom.

The doors are typically constructed of glass or plastic panels with metal frames and, while functional, are not very attractive.

The present invention relates to means for improving the attractiveness of shower or tub doors by screening same with a curtain. The appearance of the doors is enhanced, while the function and movement of the doors is not affected.

Briefly, the arrangement of the present invention includes a curtain positioned across the door. Rod pockets are sewn along each end of the curtain. A rod extends through each of the rod pockets adjacent the top and bottom of the door.

A plurality of attachment members fasten the curtain to the top and bottom of the door. Each of the attachment members includes a first hook engaging one of the rods and a second hook that fits into the grooves or over the frame at the top and bottom of the door for retaining the curtain on the door. The attachment member may include an elastic element between the hooks that places the curtain in tension and assists in retaining it on the door. Covering members may extend beyond the ends of the curtain to cover the rods and attachment members to retain the attractive appearance of the curtaining arrangement.

The invention is further explained in the following detailed description with the aid of the drawings in which.

Figure 1:
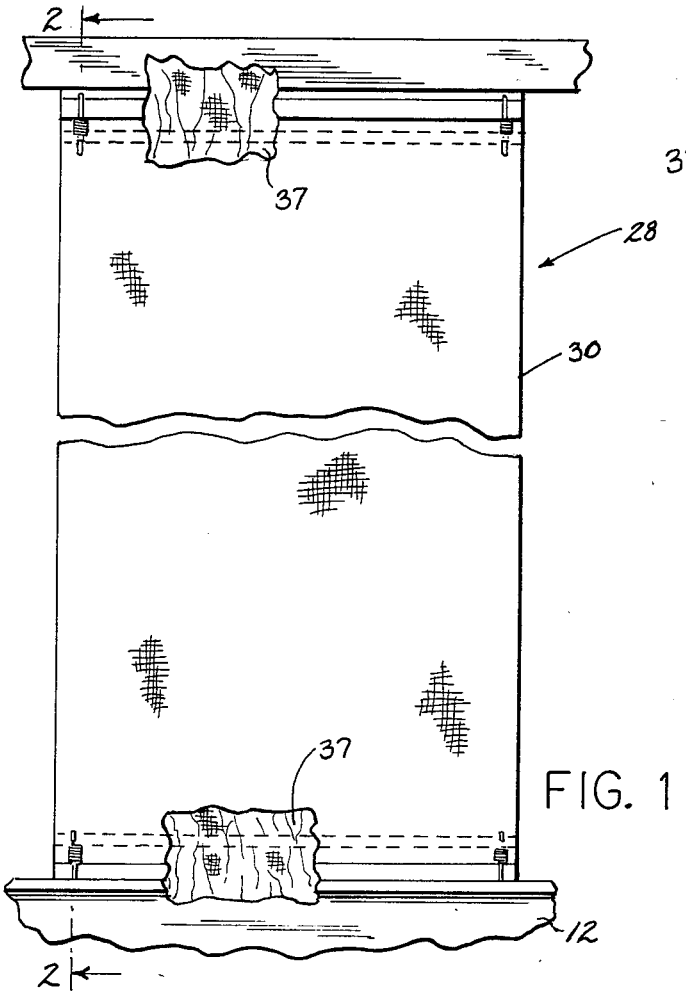
FIG. 1 is a front view of a door and associated portions of a tub enclosure, the shower door having one embodiment of the curtaining arrangement of the present invention.
Figure 2:
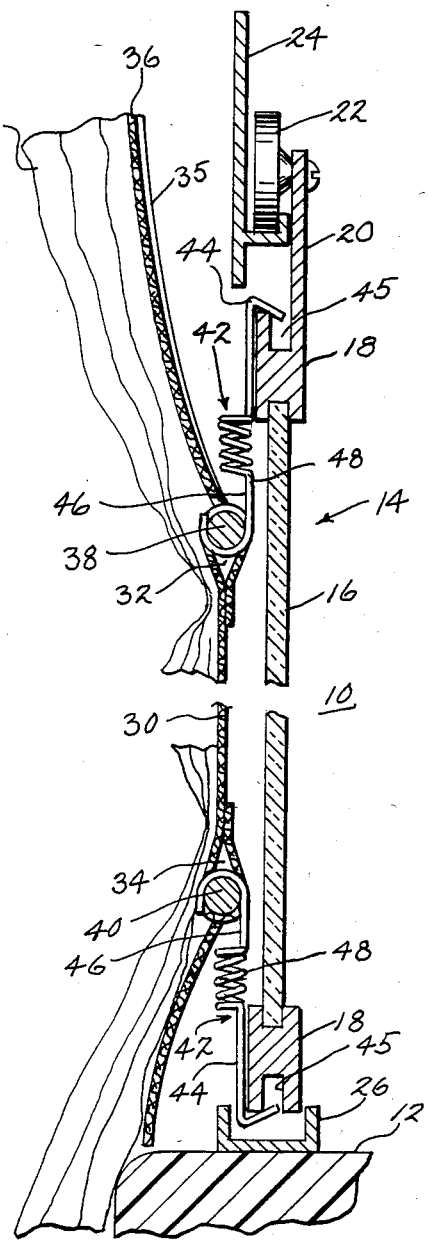
FIG. 2 is a cross-sectional view taken along the line 2—2 of FIG. 1.

FIGS. 1 and 2 show shower stall 10 including bath tub 12. Sliding shower doors cover the entrance to stall 10 to prevent water from splashing out. One such shower door is shown as 14. Shower door 14 is formed of glass or plastic panel 16 contained in metal frame 18, the top and bottom portions of which are shown in FIG. 2. Frame 18 includes bracket 20 mounting roller 22 for moving in track 24. Track 24 may be fastened to the ceiling of the bathroom or comprise a separate member extending across the opening of shower stall 10. The bottom of frame 18 is guided in track 26 fastened to the top of tub 12.

To improve the attractiveness of door 14, it is screened by decorative curtain 28 that covers both panel 16 and frame 18, thereby to enhance the appearance of both the door and the bathing area.

Curtain 28 includes material 30, the ends of which are folded over and sewn to form horizontal rod pockets 32 and 34 spaced from the top and bottom of the curtain. A pellon 35 is fastened to header 36 at the top of the curtain to stiffen the header. Ruffling 37 is fastened at the top and bottom of the curtain. The top ruffling is tacked to the header so that the ruffling remains upright in the presence of steam from the shower.

For prefabricated curtains, a plurality of rod pockets may be provided in the top and bottom headers to accommodate doors of different heights. Or, a generous folded header may be provided on the curtain and the rod pocket sewn in once the dimensions of the door are known.

Rods 38 and 40 are slid into rod pockets 32 and 34 and the curtain material 30 gathered so that is falls into folds.

Figure 4:
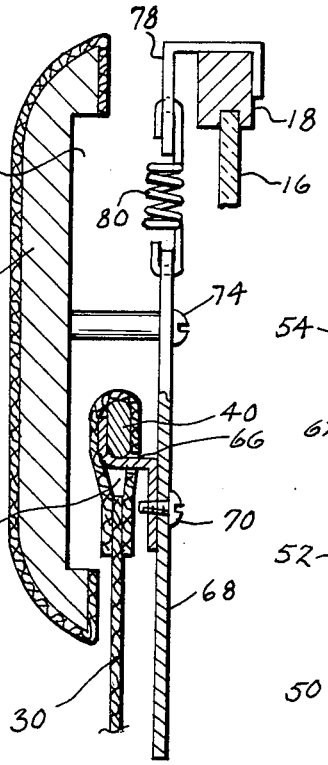
FIG. 4 is a partial cross-sectional view, similar to FIG. 3, showing yet another embodiment of the curtaining arrangement of the present invention.

Attachment members 42 are used to affix curtain 28 to door 14. Hooks 44 fit over the top and bottom. They may fit into grooves 45 customarily provided in frame 18. While hooks 44 are shown as slanted in FIG. 2, they may be curved, or rectangular or of some other shape suitable for the configuration of door 14. If there are no grooves in frame 18, the hooks may fit over the frame, as shown in FIG. 4. Hooks 46 fit around rods 38 and 40. Hooks 46 may extend through openings in the material 30 of curtain 28 or may fit around the ends of the rods beyond curtain material 30 and covered with ruffling 37. Springs 48 are connected between hooks 44 and 46 to place curtain 28 in tension and retain it on door 14. Ruffling 37 hides hooks 44 and springs 48 to maintain the attractive appearance of curtain 28. Finials may be added to the ends of the curtain rods, if desired.

Figure 3:
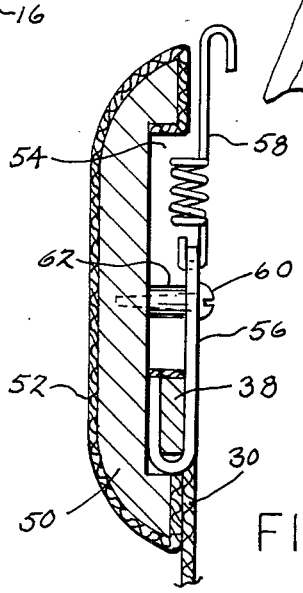
FIG. 3 is a partial cross-sectional view showing another embodiment of the curtaining arrangement of the present invention.

FIG. 3 shows another embodiment of the screening means of the present invention. Curtain 28 is formed generally in the manner described above. As shown in FIG. 3, the attachment member is covered by a board 50 upholstered with fabric 52. Rod 38 may be a flat rod fitting in a pocket 54 in board 50. The attachment member is in two parts—sheet metal hook 56 engaging rod 38 and hook spring 58 that mounts on door frame 18. Screw 60 passes through spacer 62 into board 50 to secure the board to the attachment member. The sheet metal hook 56 may be slotted, if desired, to adjust the position of board 50.

If desired, both the rod hook and the mounting hook may be formed of sheet metal with a separate spring element between them. The sheet metal mounting hook may be bent to the configuration necessary to engage frame 18.

FIG. 4 shows another embodiment of the curtain arrangement of the present invention. Rod pocket 64 forming a pocket for rod 40 is fastened to curtain material 30. Rod hook 66 extends through a slit in the rod pocket around rod 40.

Rod hook 66 is fastened to a slotted strap of metal 68 by sheet metal screw 70 so that rod hook may be adjustably affixed to strap 68 to establish the tension in curtain 28. Fabric covered board 72 is adjustably fastened on strap 68 by screw 74 fitting in the slot in strap 68. Board 72 is positioned to place rod 40 and the end of curtain material 30 in interior pocket 76 so as to maintain the attractive appearance of curtain 28.

Mounting hook 78 comprises a strap bent to the configuration of frame 18 and fastened to strap 68 by spring 80. Spring 80 can be omitted at one end of curtain 28 so that strap 68 and mounting hook 78 may comprise a unitary element.

It will be appreciated that for two or more sliding doors, the outer door would typically receive curtain 28. When not in use, the inner door or doors would be moved behind the outer door.

Various modes of carrying out the invention are contemplated as being within the scope of the following claims particularly pointing out and distinctly claiming the subject matter which is regarded as the invention.

I claim:

1. A curtaining arrangement for covering a shower or tub enclosure door comprising:

a curtain positioned across said door and having a rod pocket across each end thereof;

a rod extending through each of said rod pockets adjacent the top and bottom of the door;

a plurality of attachment members at the top and bottom of the curtain, each of said attachment members including first means engaging said rods and second means engageable with the top or bottom of the door for retaining the curtain on the door; and means extending beyond the ends of said curtain for covering said rods and attachment members, said covering means comprising a solid beam-like member having a covering, said member being fastened to said attachment members.

2. An arrangement as in claim 1 wherein at least one attachment member at at least one end of the curtain includes an elastic element between said first and second means for placing said curtain in tension.

3. An arrangement as in claim 1 wherein said attachment members are formed as unitary structures.

4. An arrangement as in claim 2 wherein said one attachment member is formed as a unitary structure.

5. An arrangement as in claim 1 wherein said attachment members are formed of a plurality of elements.

6. An arrangement as in claim 2 wherein said one attachment member is formed of a plurality of elements.

7. An arrangement as in claim 1 wherein said covering means is adjustably fastened to said attachment members.

8. An arrangement as in claim 1 wherein said first means is adjustably mounted on said second means.

9. An arrangement as in claim 8 wherein said first means is adjustably mounted on a strap that is coupled to said second means.

* * * * *